United States Patent [19]

Benetta et al.

[11] 3,998,655

[45] Dec. 21, 1976

[54] METHOD FOR CLEANSING VINYL CHLORIDE POLYMERIZATION REACTORS

[75] Inventors: Gianni Benetta, Milan; Francesco Testa, Bresso (Milan), both of Italy

[73] Assignee: Societa' Italiana Resine S.I.R. S.p.A., Milan, Italy

[22] Filed: July 23, 1975

[21] Appl. No.: 598,479

[30] Foreign Application Priority Data

Sept. 10, 1974 Italy ..... 27116/74

[52] U.S. Cl. ..... 134/12; 134/13; 134/22 R; 134/38; 203/47

[51] Int. Cl.[2] ..... B08B 7/04

[58] Field of Search ..... 134/10, 12, 13, 22 R, 134/22 C, 38; 264/184, 39; 260/92.8 A; 210/42; 203/47

[56] References Cited

UNITED STATES PATENTS

| | | | |
|---|---|---|---|
| 3,740,267 | 6/1973 | Haylock | 134/10 |
| 3,764,384 | 10/1973 | Berni | 134/13 X |
| 3,879,506 | 4/1975 | Melacini et al. | 264/184 X |

*Primary Examiner*—S. Leon Bashore
*Assistant Examiner*—Marc L. Caroff
*Attorney, Agent, or Firm*—Sughrue, Rothwell, Mion, Zinn & Macpeak

[57] ABSTRACT

Incrustations of vinyl chloride polymers and copolymers are removed from the polymerization reactors by dissolving said incrustations at a temperature above 60° C in a solvent chosen from the substituted amides up to a polymeric compound content in the resulting solution not exceeding 7% by weight, concentrating the resulting solution to a 10–30 wt. % polymeric compound content by evaporating a mixture of solvent and water, extruding the concentrated solution into an aqueous coagulating bath and recovering the spun product. The solvent is recovered by fractional distillation of the vaporized mixture and of the solvent-enriched coagulating bath.

14 Claims, 3 Drawing Figures

METHOD FOR CLEANSING VINYL CHLORIDE POLYMERIZATION REACTORS

Figure 1:
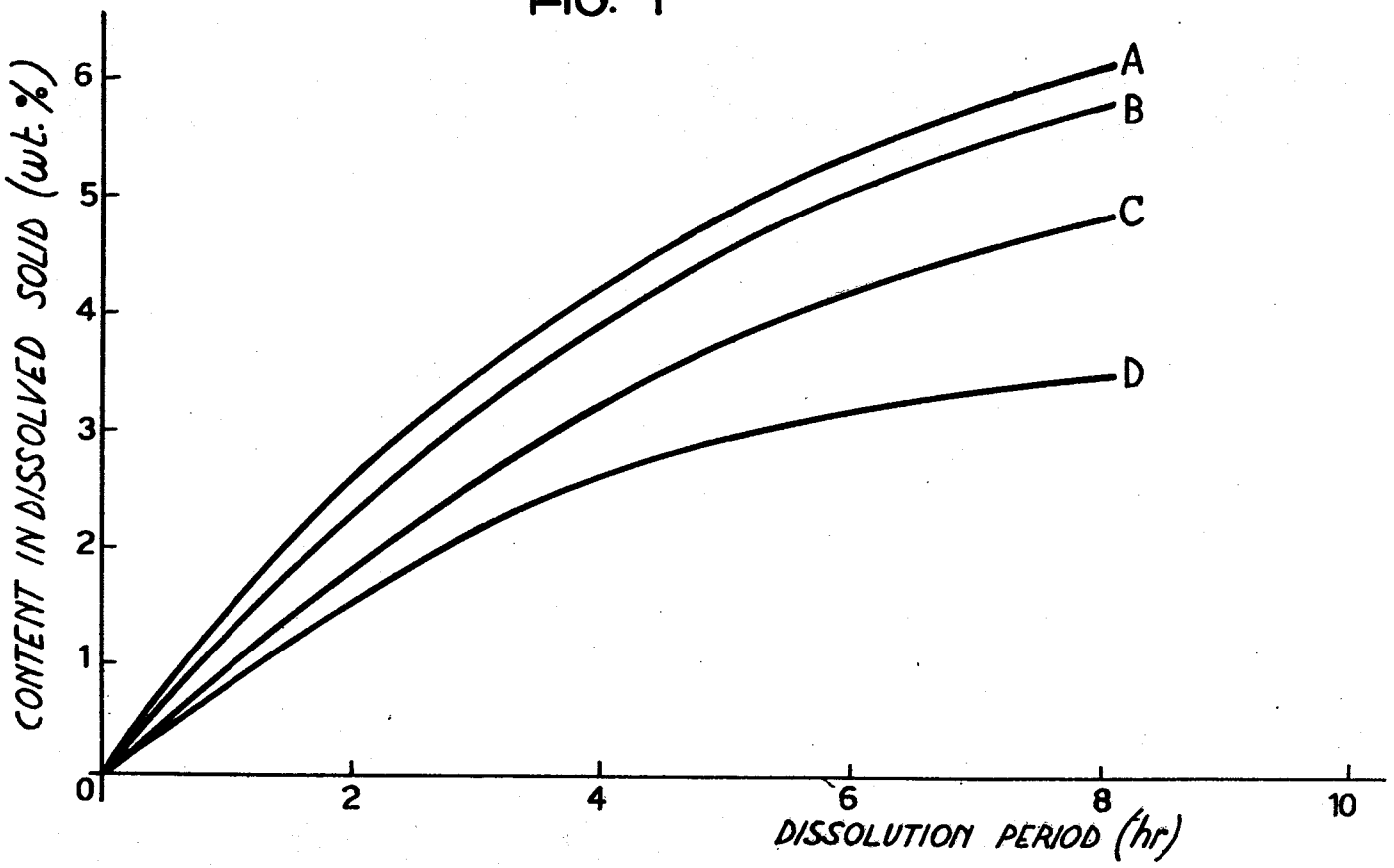

The present invention concerns a method for cleansing vinyl chloride polymerisation and copolymerisation reactors.

More particularly, this invention concerns a method for the removal and recovery in a useful form of the polymer deposits which form on the inner surfaces of the reactors and on the related equipments during polymerisation and copolymerisation of vinyl chloride.

It is in fact known that during polymerisation and co-polymerisation of vinyl chloride, either in emulsion, in suspension or in bulk, there are formed on the internal surfaces of the reactors and on the related equipments, polymer deposits which constantly increase, giving rise to compact masses, difficult to remove.

The compact masses are the cause of a series of serious problems which affect both the manufacture and the quality of the polymer or copolymer of vinyl chloride, which from now on will be referred to, for the sake of simplicity, only as polymer.

The parts most subject to fouling are the inner surfaces of the polymerisation autoclaves, especially at the waterline area the places where the enamel has come off, and also the baffles, the shaft, the blades and the hubs of the agitators, the roof of the autoclaves, the orifices and the stub pipes connecting with the service pipes, the inner surfaces of the reflux condensors.

A serious disadvantage of this phenomenon is a deterioration in the quality of the final polymer by contamination by pieces of crust and impervious paticles ("fish-eyes") which become detached and remain enwrapped in the said polymer.

Another disadvantage is the diminution, as a result of the deposits of polymeric materials, of the exchange capacity of the autoclave and of the condensers with consequent deterioration in thermal conductivity and also in the capacity of the said autoclave.

Another disadvantage, apart from appreciable lowering of the manufacturing yields, is the progressive obstruction of the orifices and of the stub pipes connecting with the duty piping. This fact, apart from involving difficulties in loading the reactor, can bring about dangerous situations through obstruction of the pipeline leading to the safety valve.

When a certain degree of fouling is reached, it is therefore necessary to remove the incrustations from the inner surfaces of the reactors and from the relative equipments. Generally this removal operation is effected manually by one or more operators who descend into the autoclave and with the help of hammers, chisels or other tools, have to break and detach the incrustations, which often adhere very strongly.

This method of procedure, however, involves a series of further disadvantages. Especially, the working conditions are very hard and dangerous for the operator who is obliged to work in an environment which is narrow, closed-in, and damp, in the presence of fumes of vinyl chloride monomer, and with a precarious balance. The extreme likelihood of dropping tools or the acccidental blows may cause considerable damage to the enamelled surfaces, with consequently easier and quicker fouling of the said surfaces during polymerisation. These cleansing operations, being wholly manual, require moreover many operators and in any case very long periods of stopping, with consequent lowering of the efficienty of the plants.

All this, together with the fact that the polymeric crusts detached, in view of their very poor qualities, can be used only with difficulty, makes a heavy burden on the economic side of the processes.

For these reasons, in order to eliminate the disadvantages set out above, an attempt has been made to turn to methods other than manual, but so far with discouraging and in any case only partial results. For example it was attempted to reduce fouling of the reactors and relative equipments by an accurate selection of the reaction conditions and the addition of special additives to the reaction mixture. There was also suggested a washing of the autoclaves with high pressure jets of water, possibly by automaic spraying systems, after every polymerisation cycle. Others, again, turned to cooling with water or other fluids at low temperature, of the vital zones of the reaction apparatus (waterline, top, stub pipes connecting with the piping, baffle, etc.) for preventing polymerisation and copolymerisation of vinyl chloride at these zones. Others, also, have applied to the vital zones compounds which are able to inhibit polymerisation.

By these methods, it is only possible to slow down the growth of the incrustations; but manual cleansing cannot be avoided, with all its disadvantages and dangers described above.

More recently there has been suggested the use of solvents to be introduced into the reaction vessel, once the reaction product has been discharged, which dissolve and wholly remove the polymer crusts from every point of the apparatus.

Thus, it has been proposed to use 1–2 dichloroethane, which is sprayed upon the walls of the autoclave. The cleansing efficiency is, however, in this case, conditional upon the humidity content of the polymer crusts. Therefore it is necessary in this case to effect first a long, and not easy, drying.

There has also been suggested the use of tetrahydrofurane which is known to be a good solvent for vinyl chloride polymers. The cleansing operation is carried out at a temperature of 80°–100° C, under agitation, wholly filling the autoclave with solvent which is continuously recycled.

Although tetrahydrofurane is a good solvent, it has nevertheless disadvantages which make it not very suitable for cleansing the reactors for the polymerisation and copolymerisation of vinyl chloride. In the first place, tetrahydrofurane is an expensive solvent, so that even small losses of the latter bear heavily on the economy of the process. Its dissolving power is moreover very adversely influenced by the presence of water and is drastically reduced with water contents greater than 8%.

After regeneration of the solvent there still remains in the latter a quantity of water of about 6–8% and hence we are at the limit of its solvent efficiency. Since the crusts of polymer carry a considerable quantity of water, the 8% limit is quickly exceeded. In practice, after few, generally only two, cleansing operations of an industrial reactor the tetrahydrofuran has to be sent back again to the purification system with heavy incidence on the costs of the cleansing.

Finally, tetrahydrofuran has a relatively low boiling point, whereby at the discharge of the hot solution at the end of cleansing there remains on the walls a deposit of polymer formed by evaporation of the solvent which was in contact with the walls. For a complete cleansing, it is necessary to spray fresh solvent. The losses in solvent will be on the whole considerable, due to the high volatility of the latter.

Moreover the polymeric products recovered are generally of poor quality and find scarcely interresting applications.

One object of this invention consists of a method for cleansing polymerisation and copolymerisation reactors of vinyl chloride, which shall make it possible to avoid the disadvantages of the prior art, especially by the use of an economical solvent which can be used many times, without laborious purifying operations.

Another object of this invention consists of a simple and convenient method, making it possible to remove and recover in a useful form the polymer deposits which form upon the inner surfaces of the reactors and on the relative equipments during polymerisation and copolymerisation of vinyl chloride.

Thus, the invention provides a process for cleansing reactors used for polymerizing and copolymerizing vinyl chloride characterized by:

dissolving the polymeric incrustations including residual water, formed during the polymerization and copolymerization of vinyl chloride on the inner walls of the reactors and on the relative equipments, with a solvent chosen from among the substituted amides, by contacting said incrustations with the solvent at a temperature above 60° C, the dissolution operations being carried out until the content in polymeric compound in the resulting solution reaches a value not exceeding 7% by weight;

concentrating the resulting solution by evaporation of a mixture of solvent and water, thereby to obtain, a residual solution having a concentration in polymeric compound of from 10 to 30% by weight:

subjecting the vaporized mixture to fractional distillation, thereby to recover the solvent present in said mixture for further dissolution operations;

extruding the residual solution in the form of threads into an aqueous coagulating bath, thus extracting the solvent from said threads, and recovering the polymeric compound in the form of a spun product and the extracted solvent from the solvent-enriched coagulating bath.

Typically, the solvents suitable for the purposes of the invention are those having a high dissolving power for the polymers and copolymers of vinyl chloride, miscible in water in any proportion and completely separable from the latter by fractional distillation, which are able to form concentrated solutions of polymers and copolymers of vinyl chloride extrudable in water in the form of filaments from which the solvent easily migrates in the aqueous coagulating bath.

The preferred solvents are those which have a high boiling point, at least above 100° C, and which do not give azeotropes with water.

It has been found that the substituted amides have the characteristics required for the purposes of this invention. The best results are obtained with dimethylformamide, dimethylacetamide and substituted carbamides such as tetramethylurea, alone or mixed together and/or with other co-solvents, but with the amide as the main component.

These products are industrially suitable both because of their reasonable cost and because of the fact that their dissolving power for the incrustations remains satisfactory even with relatively high water contents, generally up to 5% of water.

Moreover, these solvents can be used again for cleansing the reactors many times in succession without needing regeneration, in any case up to a content of dissolved vinyl chloride polymer or copolymer not exceeding 7% by weight.

For greater simplicity the process of the invention will now be described with reference to the cleansing of polymerisation reactors of vinyl chloride, but it should be understood that the said process can also be applied to the cleansing of reactors used for copolymerizing vinyl chloride with other vinylic, acrylic or olefinic monomers. Polyvinyl chloride will be shown hereinafter by the initials PVC.

Kinetic studies of the dissolution of PVC have shown that the swelling and dissolution of the polymer are connected with the diffusion of the solvent molecules and with the movements of the macro-molecular segments, aspects dependent upon the dissolution temperature.

Consequently, so as to shorten the dissolution cycles of the incrustations, as is clearly illustrated and discussed further on, the dissolution is carried out at a temperature above 60° C, generally in the range from 60° to 110° C and preferably at a temperature not less than the temperature of vitreous transition of the PVC (82° C). The optimal range of temperatures is from 80° to 110° C.

In practice, the reaction vessel is filled with solvent and maintained, preferably under agitation, at a temperature in the above range of values for the time necessary for a complete dissolution of the incrustations. Said time is generally of from 2 to 10 hours.

During the dissolution at elevated temperature of the PVC incrustations, there are inevitably freed small quantities of hydrochloric acid, which reacts with the amide to give the hydrochloride of the corresponding ammine.

These products have been found to be degradation catalysts of PVC. Hence, in order to avoid phenomena of darkening of the solution, of degradation of the PVC and the formation of cross-links, it is convenient to add to the solvent small quantities of products known as heat-stabilizers of PVC and which are normally added to the polymer during the processing into manufactured articles.

Stabilizers which have proved to be efficacious are those based on salts of barium and cadmium, lead, calcium and zinc, of tin, and especially the tin marcaptides, which protect the solution from any degradation, even introduced in the solvent in very small proportions, such as from 0.05 to 0.5% by weight.

The stabilizer is preferably mixed with the solvent before starting the cycle of dissolution operations so as to protect the solution both during the cleansing operations proper (dissolution) and during the subsequent recovery of the solvent.

The solution resulting from a first cleaning operation is generally recycled as such for further cleaning operations, preferably up to a PVC content of from 3 to 7% by weight, as a function of its water content. The solution is then concentrated by removing the solvent and the water present up to a polymer concentration of from 10 to 30% by weight. In these conditions the concentrated solution has a degree of viscosity such that it can be easily extruded to form filaments in the aqueous coagulating bath.

Evaporation can be effected in any evaporator allowing the removal, at the top, of the solvent and the water, and at the bottom, of the concentrated solution; in practice, in flash evaporators, static thin film evaporators, descending or rotating film evaporators, or else in simple stirred vessels. The pressure can be maintained at atmospheric value, but it is preferable to operate at subatmospheric values, such as in the range from 1 to 0.2 atmospheres.

The vaporised mixture is then subjected to fractional distillation so as to separate the solvent from the water. For this purpose one can operate according to the known methods. using for example packed or trays carrying columns, at ambient pressure or preferably at a subatmospheric pressure in the range from 1 to 0.2 atmospheres, and under reflux.

One can with advantage utilise a column carrying from 10 to 50 plates, feeding the mixture to be fractionated at a height between the third and the seventh plate from the bottom.

Under these conditions, water is removed at the top of the column and the solvent recovered at the bottom has a purity degree exceeding 99% and usually around 99.5 – 99.7%.

The water can be fed partly as reflux at the top of the fractionating column, and the remainder to the spinning bath.

The concentrated polymer solution issuing from the evaporator is pumped and extruded through a spinneret into the aqueous coagulating bath. Usually one uses spinnerets from 100 to 500 microns in hole diameter and an extrusion speed between 1 and 8 meters per minute.

The spinneret is immersed in the aqueous coagulating bath, the latter being generally at a temperature from ambient value (20° C) to 100° C.

The coagulating bath is conveniently of such length as to ensure a residence time from 5 seconds to 60 seconds. The solvent concentration in the bath can rise up to 50%, above which value the extrudate coagulation becomes poor and the solvent extraction insufficient.

The extruded thread can then be drawn to many times its length, preferably from 1 to 8 times. In practice, for the coagulation and subsequent drawing of the extrudate one can advantageously use a tank with rollers allowing a horizontal dragging.

The coagulating bath, apart from coagulating the extruded thread, also extracts the residual solvent incorporated in the said thread. Under the conditions given above, the migration of the solvent from the threads to the water bath occurs substantially and speedily through the porous structure of the said threads.

The bath can moreover be easily regenerated by fractional distallation and the solvent thus removed can be recovered and re-used. It is convenient to regenerate said bath in the fractionating column used for recovering the solvent from the evaporated mixture, together with the latter, preferably by feeding it into the zone of the column which has about the same composition as the said bath, so as not to create unbalances.

Thus, recovery of the solvent from the solution resulting from the dissolution of the incrustations can be effected in two stages.

In the first stage, there is recovered by normal distillation 70 – 90% of the solvent.

In the second stage, the polymer solution concentrated to 10 – 30% is extruded in the form of threads in the aqueous coagulating bath which extracts the residual solvent. The solvent-enriched coagulating bath is then in its turn passed in the fractionating column which completely separates the solvent from the water.

Since no azeotrope is formed, the solvent thus recovered has a degree of purity above 99.5% by weight. The almost total elimination of water makes it possible to re-use the recovered solvent for a very great number of times.

The method of this invention is especially advantageous since, apart from ensuring a simple and effective cleansing of the polymerisation reactors, it allows the recovery of the polymer incrustations in a useful form, as monofilaments as such or else reduced to granules for current uses of PVC.

Moreover the method of this invention is also very convenient in industry because of the use of solvents of very limited cost, which can in every case be recovered practically totally and re-used for cleansing the reactors for a very great number of times, depending upon the degree of fouling of the apparatus and upon the quantity of water remaining in the pipes, on the walls of the vessel and absorbed into the crusts of PVC.

Figure 2:
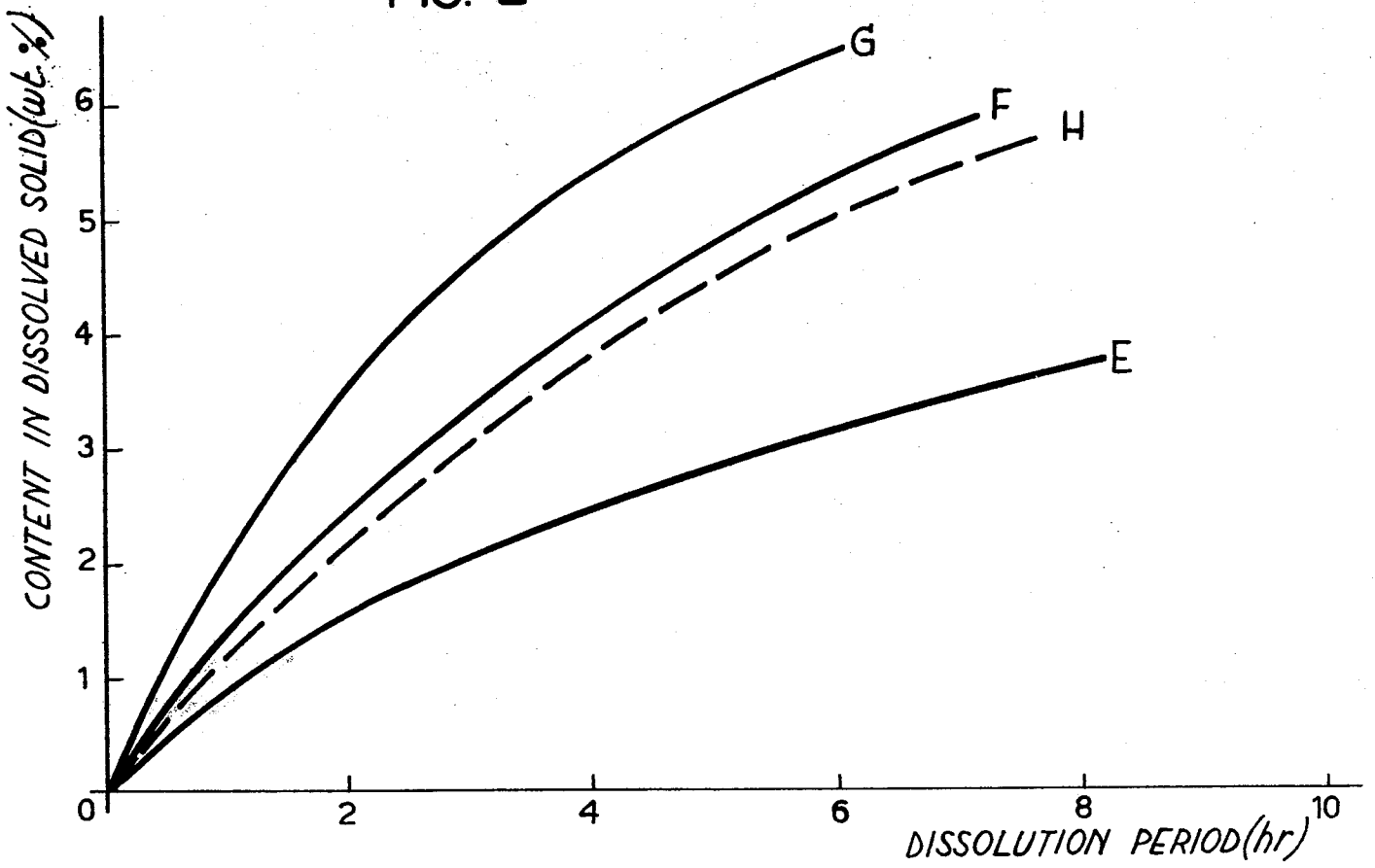
Figure 3:
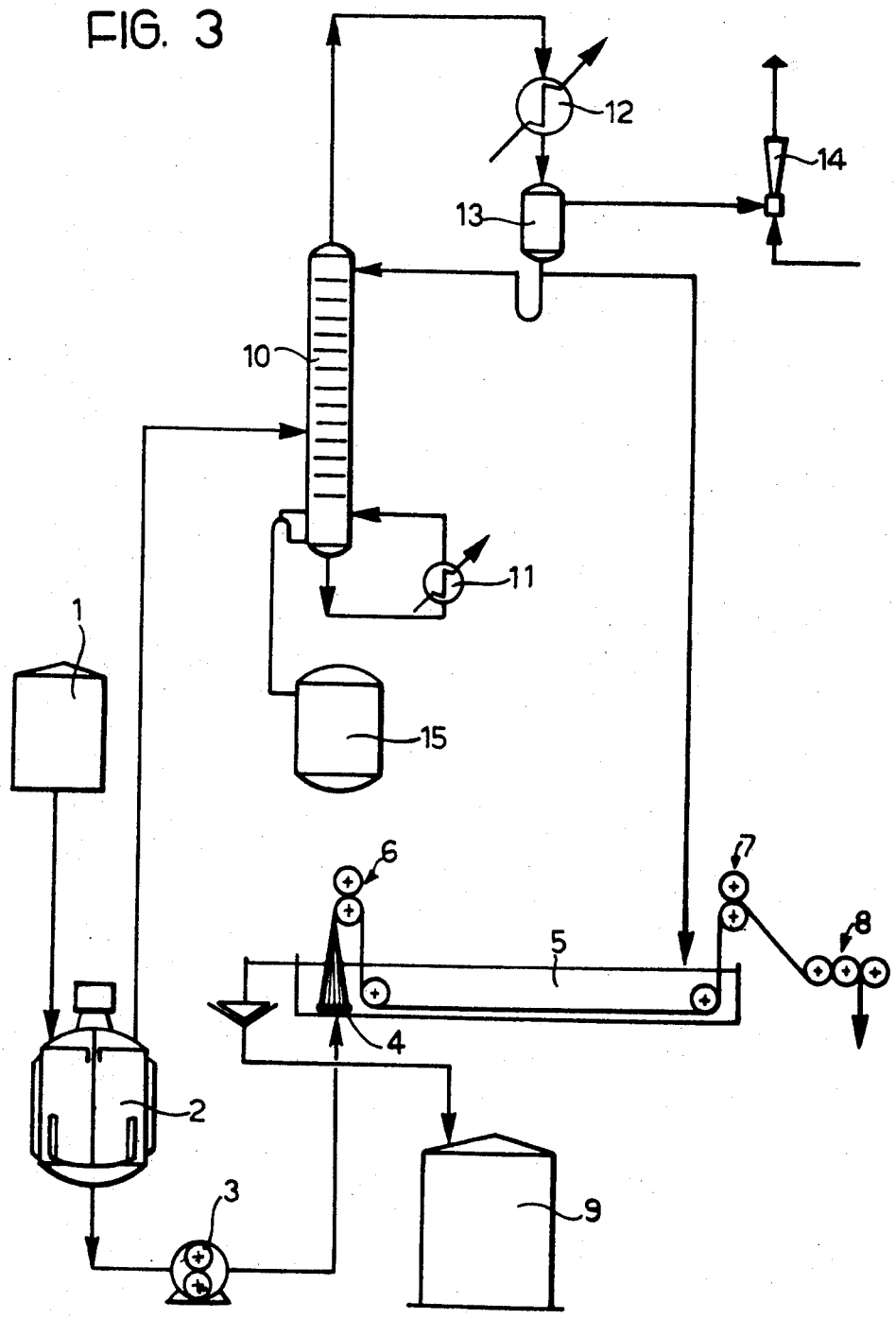

The invention will now be further illustrated by the following Examples, with reference to the accompanying drawings, in which:

FIG. 1 shows the dissolution curves at 88° C of a sample of PVC crust in dimethylformamide as a function of the content in water of said dimethylformamide, these curves being obtained by plotting the content in percentage by weight of dissolved solid (PVC) in the resulting solution, in ordinates, against the dissolution period in hours in abscissae, FIG. 2 shows the dissolution curves of a sample of PVC crust as a function of the solvent used or of the dissolution temperature, these curves being obtained by plotting the content in percentage by weight of dissolved solid (PVC) in the resulting solution, in ordinates, against the dissolution period in hours in abscissae, and FIG. 3 is a diagrammatical representation of a pilot plant devised for recovering the solvent and the polymer from a cleansing solution according to the process of the invention.

In the Examples, the percentages are by weight unless otherwise specified.

EXAMPLE 1

Into a glass autoclave of 3,000 cc equipped with a stirrer, a thermometer and a heating jacket, there is introduced a small cube, of 5 × 5 × 5 cm, taken away from a compact crust of PVC extracted from an industrial autoclave used for suspension polymerisation of vinyl chloride. 1900 g of dimethylformamide (shown for simplicity as DMF) and 3.8 g of tin dibutyl mercaptide are loaded.

The mixture is stirred and heated at 88° C. By drawing samples of the solution, the gradual dissolution of the PVC crust is followed and the curve (A) shown in FIG. 1 is obtained. By observing the solution being stirred there is noted a gradual diminution of the dimensions of the crust right up to its complete dissolution.

Tracing the tangent to the kinetic curve (A) of FIG. 1, for a solid concentration between 0 and 2%, an initial dissolution speed of 0.178 g PVC per $cm^2$ and per hour is registered. The dissolution speed is expressed herein in grams of solid (PVC) dissolved per $cm^2$ of solid-solvent interface surface and per hour.

EXAMPLES 2–4

Procedure is as in Example 1, introducing initially, together with the DMF, various quantities of water. There are obtained the dissolution curves (B), (C), and (D) shown in FIG. 1 and the speeds of dissolution shown in Table 1.

Table 1

Effect of the concentration of water on the initial dissolution speeds.

| Example No. | Dissol. temperature (°C) | Concentrat. $H_2O$ in the solvent (wt.%) | Speed of dissol. g PVC/cm² .h |
|---|---|---|---|
| 1 | 88 | 0.1 | 0.178 |
| 2 | 88 | 1 | 0.152 |
| 3 | 88 | 3 | 0.115 |
| 4 | 88 | 5 | 0.096 |

Thus it is shown that the dissolving power of dimethylformamide remains satisfactory even at a relatively high water concentration.

EXAMPLES 5–6

Procedure as in Example 1, varying the dissolution temperature. One gets the dissolution curves (E), (F) and (G) shown in FIG. 2 corresponding to a dissolution temperature of 75° C, 88° C and 100° C, respectively, and the speeds of dissolution shown in Table 2.

Table 2

Dependence of the speed of dissolution of the PVC crusts upon the temperature of the solvent.

| Example No. | Dissol. temperature ° C | Speed of dissol. g PVC/cm² .h |
|---|---|---|
| 5 | 75 | 0.089 |
| 1 | 88 | 0.178 |
| 6 | 100 | 0.263 |

EXAMPLE 7

Procedure as in Example 1, loading, instead of dimethylformamide, 1900 g of pure dimethylacetamide.

The curve (H) of FIG. 2 is obtained with an initial speed of dissolution of 0.160 g PVC/cm².h.

EXAMPLE 8

Procedure is as in Example 1, loading 1900 g of pure tetramethylurea instead of dimethylformamide.

An initial speed of dissolution of 0.267 g PVC/cm².h is obtained.

EXAMPLE 9

In an AISI 304 pilot autoclave of 290 l, fitted with a stirrer, a fixed baffle and a heating jacket a series of suspension polymerisation operations is carried out with vinyl chloride, charging the autoclave with water, a cellulosic suspending agent, polyvinyl alcohol, vinyl chloride, lauroyl peroxide, and polymerising at a temperature of 60° C.

At the end of the reaction, after stripping off the residual monomer, the slurry is discharged, and rinsing is effected with pure water.

After seven successive polymerisation operations, the autoclave is then almost entirely lined with a thick layer of PVC.

Large aggregations of polymer have also formed upon the shaft, especially on the hub, on the blades, on the baffle.

From the top of the reactor there hang stalactites of polymer, and the inlet orifices of the tubes are half obstructed by PVC incrustations.

The autoclave is completely filled with dimethylformamide containing 0.2% of tin dibutyl mercaptide.

Stirring is started and the temperature brought to 85° C. After 7 hours the resulting solution is cooled and discharged. The interior of the autoclave is completely clean and any trace of polymer has disappeared.

Then the autoclave is filled with water, to remove any trace of solvent, and it is discharged.

EXAMPLES 10–12

Procedure as in Example 9, re-using the solvent which was used in Example 9.

TABLE 3

| Example | Conc. init. | PVC% final | Conc. init. | $H_2O$% final | Cleansing period (hours) |
|---|---|---|---|---|---|
| 9 | 0. | 0.8 | 0.25 | 0.75 | 7 |
| 10 | 0.8 | 1.7 | 0.75 | 1.4 | 7 |
| 11 | 1.7 | 3.2 | 1.4 | 2.0 | 8 |
| 12 | 3.2 | 4.4 | 2.0 | 2.5 | 9 |

These examples show that it is possible to use the same solvent in a series of cleansing tests.

EXAMPLE 13

A test is carried out, in the pilot plant shown diagrammatically in FIG. 3, to recover the solvent and the polymer from a solution consisting of DMF 91.8%, PVC 4%, $H_2O$ 4% and tin dibutyl mercaptide 0.2%.

The said solution is stocked in the reserve tank 1 and fed at a rate of 47 Kg/h to the evaporator 2.

This latter consists of an AISI 304 autoclave of 250 l equipped with a stirrer and an oil heating jacket permitting to maintain an inner temperature of 110°–115° C.

From the bottom of the evaporator 2 the polymer solution concentrated at 20% is tapped off and fed by means of the gear pump 3 at a rate of 9.4 Kg/h to the spinneret 4 having 100 holes of 0.4 mm in diameter. The spinneret 4 is immersed in the coagulation tank 5, 5 meters long, which contains a mixture of 95% by weight of water and 5% of DMF, thermostatted at 70° C.

The threads dragged along by the rollers 6, 7 and 8 are immersed in the coagulating bath, pass through the tank and emerge with a residual DMF content of 10%.

The vapors issuing from the evaporator 2, composed of 95% DMF and 5% water, are delivered at a rate of 37.6 Kg/h. to the fractionating column 10, 180 mm in diameter and comprising 24 plates, and introduced in the column at the height of the fifth plate reckoned from the bottom.

The column 10 is fitted with an indirect steam reboiler 11, a water condensor 12 and a separator 13.

The steam ejector 14 maintains, in the evaporator 2 and in the column 10, a pressure of 200 mm Hg in order to reduce the distillation temperature and that of the solution of PVC.

Part of the water leaving from the top of the column, condensed in 12 and collected in 13 is refluxed to the column 10 with a reflux ratio R of 1.1 and the remainder is discharged into the coagulating 5.

In the tank 15 the dimethylformamide is collected with a 99.6% purity degree.

The exhausted coagulating bath is collected in a tank 9 for subsequent recovery of the DMF by distillation.

We claim:

1. A method for cleansing reactors used for polymerizing and copolymerizing vinyl chloride, which comprises:

dissolving polymeric incrustations including residual water, formed during polymerization and copolymerization of vinyl chloride on the inner walls of the reactors and on the relative equipments, with a solvent chosen from among the substituted amides, by contacting said incrustations with the solvent at a temperature above 60° C, said dissolving being carried out until the content in polymeric compound in the solution resulting from said dissolving reaches a value not exceeding 7% by weight;

concentrating the resulting solution by evaporation of a mixture of solvent and water, thereby to obtain a residual solution having a concentration in polymeric compound of from 10 to 30% by weight;

subjecting the vaporized mixture to fractional distillation, thereby to recover the solvent present in said mixture for further dissolution operations;

extruding the residual solution in the form of threads into an aqueous coagulating bath, thus extracting the solvent from said threads, and recovering the polymeric compound in the form of a spun product and the extracted solvent by fractional distillation from the solvent-enriched coagulating bath.

2. The method of claim 1, wherein said substituted amides have a boiling point higher than 100° C, are miscible with water in any proportion and completely separable from the latter by fractional distillation.

3. The method of claim 1, wherein said substituted amides are selected from the group consisting of dimethylformamide, dimethylacetamide and substituted carbamides.

4. The method of claim 1, wherein said substituted amides are selected from the group consisting of dimethylformamide, dimethylacetamide and tetramethylurea.

5. The method of claim 1, wherein the solvent is contacted with the incrustations at a temperature of from 60° to 110° C.

6. The method of claim 1, wherein the solvent is contacted with the incrustations at a temperature of from 80° to 110° C.

7. The method of claim 1, wherein a tin mercaptide is present in the solvent in an amount of from 0.05 to 0.5% by weight before said dissolving.

8. The method of claim 1, wherein the dissolving is carried out until the content of polymeric compound in the resulting solution reaches a value of from 3 to 7% by weight.

9. The method of claim 1, wherein the fractional distillation is carried out at a pressure in the range from 1 to 0.2 atmospheres.

10. The method of claim 9, wherein the fractional distillation is carried out under reflux.

11. The method of claim 1, wherein the fractional distillation is carried out in a column having from 10 to 50 plates, feeding the said mixture at a point situated between the third and the seventh plate from the bottom of the column.

12. The method of claim 1, wherein the residual solution is extruded through a spinneret of from 100 to 500 microns in hole diameter into an aqueous coagulating bath at a temperature of from 20° C to 100° C, at an extrusion speed of from 1 to 8 m/minute.

13. The method of claim 1, wherein the residence time of the threads in the coagulating bath is from 5 to 60 seconds.

14. The method of claim 1, wherein said substituted amide solvent is miscible in water in any proportion and is completely separable from water by fractional distillation.

* * * * *